US005725927A

United States Patent [19]

Zilg et al.

[11] Patent Number: 5,725,927

[45] Date of Patent: Mar. 10, 1998

[54] CLEANING CLOTH

[75] Inventors: Jan-Peter Zilg, Weinheim; Heinrich Laun, Augsburg; Michel Pässler, Neusass, all of Germany

[73] Assignee: Firma Carl Freudenberg, Weinham, Germany

[21] Appl. No.: 652,209

[22] Filed: May 23, 1996

[30] Foreign Application Priority Data

May 23, 1995 [DE] Germany ..... P 19518975.2

[51] Int. Cl.[6] ..... B32B 3/02; B32B 5/14; A47K 7/02

[52] U.S. Cl. ..... 428/89; 428/171; 15/209.1

[58] Field of Search ..... 428/89, 171; 15/209.1

[56] References Cited

U.S. PATENT DOCUMENTS

| | | | |
|---|---|---|---|
| 2,931,202 | 4/1960 | Messerli | 428/89 |
| 3,666,608 | 5/1972 | Mattes | 428/89 |
| 3,755,055 | 8/1973 | Lochner | 428/91 |
| 3,764,426 | 10/1973 | Peerenboom | 428/89 |
| 4,352,846 | 10/1982 | Pässler et al. | 428/105 |
| 4,379,189 | 4/1983 | Platt | 428/89 |
| 4,389,443 | 6/1983 | Thomas et al. | 428/94 |
| 5,080,951 | 1/1992 | Guthrie | 428/171 |
| 5,144,730 | 9/1992 | Dilo | 28/109 |
| 5,480,699 | 1/1996 | Gerhartl et al. | 428/171 |

FOREIGN PATENT DOCUMENTS

| | | |
|---|---|---|
| 2 162 213 A | 1/1986 | United Kingdom . |
| WO 90/14039 | 11/1990 | WIPO . |

*Primary Examiner*—Terrel Morris
*Attorney, Agent, or Firm*—Kenyon & Kenyon

[57] ABSTRACT

A reusable cleaning cloth for damp and dry cleaning of surfaces. The cloth is made of a textile base layer of non-woven fibers and, on the surface that provides the cleaning action, a plurality of filament loops which project out of this surface. The filament loops are concentrated in spaced apart surface regions separate from one another, like islands, by non-linear border lines delineating channels that are essentially free of filament loops. In its finished form, the island-like areas with the filament loops project 0.5 to 5 mm out of the base surface. The islands are aligned to be equidirectionally staggered relative to one another, each having a length of 4 to 50 mm with a corresponding width of 2 to 10 mm. The channels which separate the islands are as broad as one to two of these islands in the region between the adjacent long sides of the islands and narrow in the region of the adjacent ends of the islands.

17 Claims, 1 Drawing Sheet

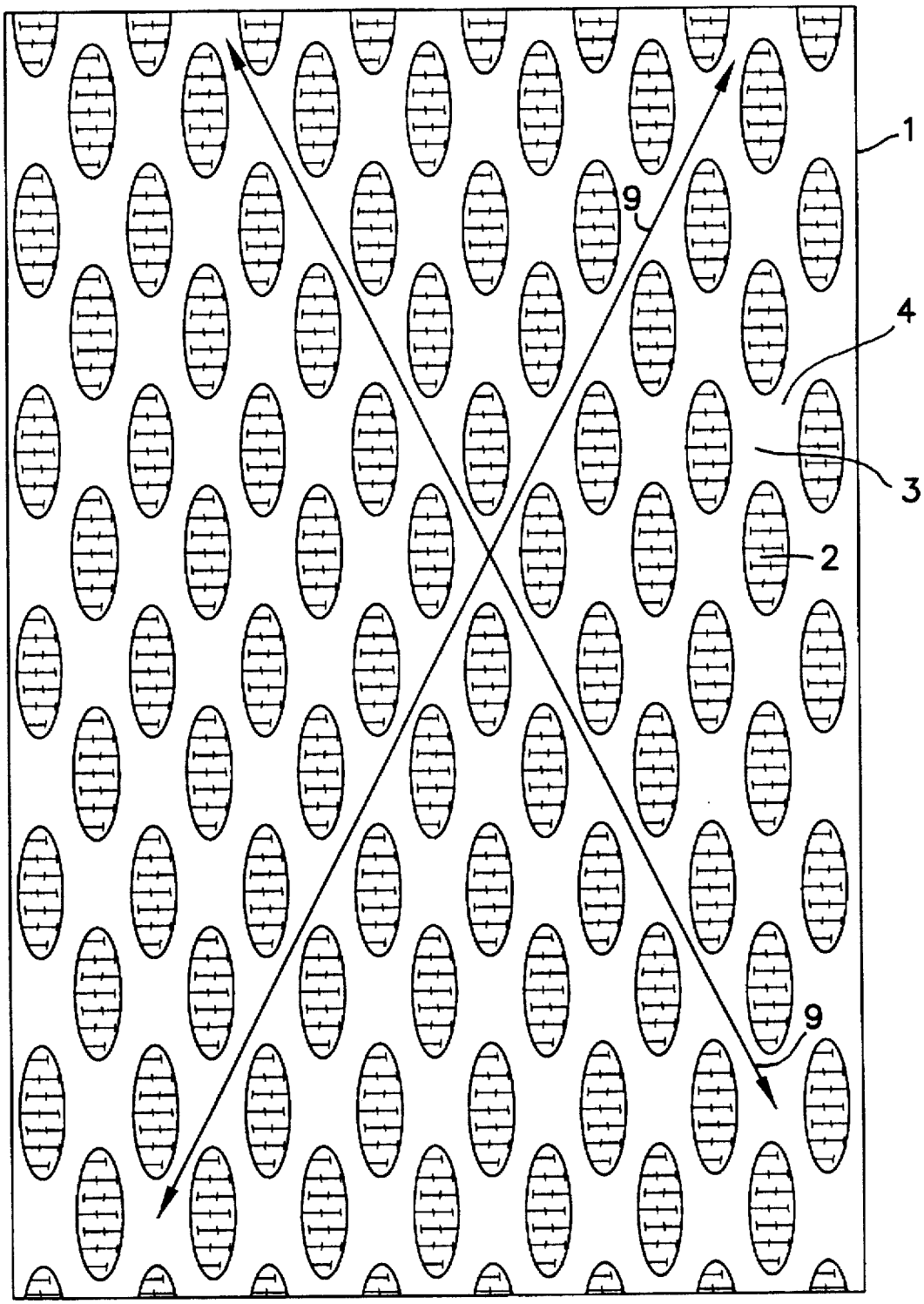
1
9
4
3
2
9

CLEANING CLOTH

BACKGROUND OF THE INVENTION

This invention relates generally to a cleaning cloth for the damp or dry cleaning of surfaces. Cloths of this general type consist of a textile base that bears a plurality of filament loops (typically produced via the needle tufting of the textile base layer). The loops are concentrated in regions separated from one another by non-linear lines that define regions free of loops. The filament loops areas and the lines separating them consist of identical or different textile materials, e.g, natural, regenerated or synthetic fibers. Such fibers can inherently possess (or be treated to acquire) anti-static properties. Similarly, thee fibers may be treated with substances to promote cleansing.

A cleaning cloth of this type is described in WO 90/14039 (the contents of which are incorporated herein by reference). A textile base layer made of non-woven fibers has a plurality of filament loops, on the cleaning surface, which project from this surface. The loops are obtained by needle-tufting the textile base layer, and are brought together to form surface regions which run along alternating regions of the cloth. These surface areas are separated by lines which extend across the entire cloth and are structured in the form of depressions. These lines are essentially free of projecting filament loops and are formed by the filament or fiber material of the textile base layer.

These depressed lines do not run linearly, but rather extend in a curved or wavy shape, which not only reduces the frictional resistance of the cloth on the surface to be cleaned, but also provides that accumulations of dirt are immediately picked up when the cloth is wiped over the surface. Since the transitions between the looped regions and the continuous lines which separate the looped regions from one another constantly change direction over their course, not only does a vertically directed pressure (relative to the wiping direction) act on the dirt particles, but in addition, a wiping force effect at an angle occurs, which causes the dirt to move across the channels. This reduces the risk that dirt particles which have become fixed in place in the region with the loops will come loose again.

At least one of the areas which has loops must extend continuously from one end of the cloth to the other; preferably, however, all the areas which have filament loops and all of the low-lying channels free of loops run continuously in the lengthwise direction of the cloth.

The filament loop areas and the lines between them can consist of the same or different textile material, such as natural, regenerated and synthetic fibers, which can be anti-static, treated to be anti-static or treated with substances which promote cleaning.

Numerous methods are suitable for production of these known cloths. The preferred method of production is one which is generally analogous to that used for the production of a terry cloth, where the starting material is a woven base surface.

The projecting loops described in WO 90/14039 can also be cut, so that the fiber bundles project from the raised surfaces at their ends. In each case, there are surface regions which stretch out lengthwise, and extend continuously at least partially over the entire cleaning cloth.

SUMMARY OF THE INVENTION

The present invention is directed to the problem of providing a cleaning cloth of the aforementioned type that provides enhanced cleaning, even on surface areas which have varying degrees of dirtiness, while minimizing the frictional resistance of the cloth. Furthermore, the cloth of this invention takes advantage of transport and dirt retention properties characteristic of the wavy lines that are free of filament loops. It is particularly the object of the invention to increase the forces per surface area which act on the dirt particles vertically and laterally when the cloth is wiped over a surface.

Briefly, the cleaning cloth comprises a textile base layer having two sides, one of which is intended for use as a cleaning surface. A plurality of filament loops (obtained by needle tufting of the textile base layer) project away from the base layer. These filament loops are grouped in a plurality of equidirectionally aligned filament-bearing islands that are evenly spaced from one another. The filaments of the islands project a distance of 0.5 mm to 5 mm out of the base surface of the cloth, and the islands are each between 4 mm and 50 mm in length and between 2 mm and 10 mm in width. (The terms "filament loops" or "loops" is to be understood, in the context of this invention, to encompass cut loops, i.e., projecting fiber bundle ends instead of curved, continuous fibers.)

The islands are arrayed along the cleaning surface of the base layer in a staggered formation with respect to their length, so that an island begins on either side of each end of an island; and the islands are spaced from one another by loop-free, relatively depressed lines of channels extending over the entire extent of the cleaning cloth. The width of these lines or channels as measured between two adjacent long sides of the islands is between one to two times the width of the islands. The width is reduced by about ½ to ¼ in the region of adjacent ends of the island surfaces.

BRIEF DESCRIPTION OF THE DRAWING

For a more detailed description of the cleaning cloth, reference is made to the FIGURE, which provides a top plan view of a section of cloth constructed according to the principles of the invention.

DETAILED DESCRIPTION

The cleaning cloth comprises island-like surfaces 2 which contain filament loops. Surfaces 2 are arranged equidirectionally with respect to one another in each instance, and project from a textile base layer 1 a height of 0.5 to 5 mm. (The term "equidirectional" as used herein means that the islands 2 are arranged in a regular, repeating pattern, so that they maintain a uniform shape, alignment and spacing from one another.)

The islands 2, which are formed of a plurality of filament loops made of filaments, each have a length of 4 mm to 50 mm and a corresponding width of 2 mm to 10 mm. For enhanced practicality, the length of each island 2 is at least twice its width.

This "fill the gap" arrangement has the result that another island-like surface 2 starts on both sides of each narrow end of any given island 2. Each of these ends is separated from the beginning/end of the adjacent, offset island 2 on both sides by a loop-free area 4 which is depressed relative to the area 2.

According to this design, depressed zones are provided between the islands 2, which are free of projecting loops and which may be viewed as periodically changing their course. These zones are formed from the textile base layer 1, and extend continuously over the entire cleaning surface. As measured laterally across region 3 between adjacent islands 2, this zone has a width equal to or up to two times that of the maximum width of a given island 2. On the other hand, within the region 4, where the adjacent ends of islands 2 appear to be staggered with respect to one another, they decrease in width by about ½ to ¼ of their original amount. The loop-free regions thus have the appearance of channels (9).

The structure of the wiping surface of the cloth of the invention provides for a more complete cleaning effect, both in the wet and the dry state, even for firmly adhering dirt, as compared with the state of the art discussed above. For example, the cleaning effect which can be achieved by wiping a cloth constructed according to the principles of the invention just one time is equal to multiple or circular wiping with a prior art cloth (such as WO 90/14039).

This significant and unexpected improvement of cleaning effect results from the arrangement of the projecting areas 2 in the form as separate, staggered islands of looped material which project out of the cleaning surface of the cloth throughout its use, and which act on the dirt with an aggregate edge length that is greater than that provided by the aforementioned prior art arrangement. The use of staggered islands provides for a greater edge length than does the use of continuous regions of loops (as taught in the prior art), so that the aggregate lateral and vertical pressure effect provided by these surface edges is greater.

The use of progressively narrowing (as at 4) and widening (as at 3) zones of relatively depressed strips and channels 9, which clearly narrow at 4 and combine at 3, has beneficial consequences. The dirt particles are transported along the channels until they make contact with the fiber loops of the islands 2, which then firmly holds the particles in place. Such transport along the channels 9 is typically short range, as particles will be caught in the loops of an island 2 before traversing a long distance (since it is most improbable that a wiping action would be along a direction exactly parallel to the channels or strips between the islands 2). These particles are thus generally only moved over the broad regions 3 between the lengthwise sides of adjacent island-like loop regions. In any other orientation (which encompasses virtually every orientation likely to be seen in use) particles of dirt necessarily make contact with fiber loops and are caught therein, typically as soon as they reach the zone of the strip narrowing at 4, i.e. in the region of the narrow ends of adjacent islands.

In spite of the equidirectional alignment of the cleaning surface, for all but the very improbable case of wiping motions that are perfectly parallel to the channels 9, it is not possible for dirt particles to be transported for longer than one wiping stroke without making contact with the fiber loops.

A number of techniques can be employed to manufacture the fiber loops. For example, one can proceed from the terry cloth manufacturing technique proceeding from a woven textile, as already noted. Alternatives are set forth in the reference GB 2 162 213 A; e.g., needle tufting of a nonwoven fiber textile, where fibers or filaments are pulled out of the back surface of the cloth, through this surface, onto the cleaning surface, in loop form, by means of back hooks. In other words, the fiber loops consist of material of the opposite surface. It is also possible to push concave curved needle ends through the base nonwoven material from the opposite side.

In a similar known method, so-called texture needle machines, such as those manufactured and sold by the Dilo company, are used. Here, the amount of the projecting fiber loops can be regulated within a wide range, by appropriate selection of needle types and the number of strokes of the needles. The height of the projecting fiber loops can be regulated by the penetration depth of the needles. The use of such texture needle machines is known to those skilled in the art.

The rough texturing necessary to form the cleaning cloth of looped island regions 2 and loop-free depressions between the islands is provided by appropriate selection of the arrangement of the needles on the needle board, in accordance with the desired arrangement of the loop-bearing regions 2 on the finished cleaning cloth.

In a preferred embodiment, the textile base layer 1 consists at least partially of cellulose fibers, and the loop-bearing, island-shaped regions 2 consist of synthetic filaments, preferably of polyester. This choice of materials provides for a particularly effective level of resistance against the dirt particles when the cloth is wiped.

It is also possible to select cellulose fibers for the projecting regions 2, if the absorbent effect is intended to be predominate on the surface being wiped. In accordance with the manufacturing techniques employed, it is then necessary to ensure that the non-wiping surface of the cloth contains a majority of the fibers which later form the loops, prior to the formation of the loops.

It is preferred from the stand-point of ease of manufacture and cost method, the provision of good working properties (e.g., cloth strength), and availability of the base material 1, that the cleaning cloth be provided in the form of a non-woven surface structure (i.e., a non-woven material).

In an optically distinctive variant, the island-like projecting regions 2 are colored differently as compared with the lines between them. The technical effect of cleaning is made visually clearer in this way. By concentrating fibers of different colors on the back and front of the cloth, before making the loops, such an effect can easily be achieved.

The fiber thicknesses can be adapted to the particular intended use; for cleaning rougher surfaces, titers of 100 dtex are the preferred choice; for polished surfaces, fiber or filament thicknesses down to 1 dtex can be used.

Depending on the particular use, the surface weight of the cloth can vary from 50 to 500 g/m$^2$. For example, for manual work lighter types will be preferred, while cloths used as components of cleaning machines and equipment can have a weight up to 500 g/m$^2$, in order to increase the pressure during the cleaning process.

The cleaning cloth is well suited for all applications in which dirt particles must be removed from surfaces by dry or wet wiping. Examples of particular applications, in addition to cloths by themselves, include cleaning pads, which consist, for example, of a sponge which is covered on one surface with the cleaning cloth according to the invention.

In another application, the cleaning cloth may be used as a covering for a floor or window cleaning apparatus which has a long handle and a holder device for the cleaning cloth (i.e., a mop). In such an application, the cleaning cloth has holder tabs or holder loops into which the attachment devices engage. It is furthermore possible to bring several strips of the cleaning cloth together at their short edges, in each instance, and to use them in this form as the strands of a mop.

The cleaning cloth is also well suited for use as cleaning strips in brushless car wash systems.

What is claimed is:

1. A reusable cleaning cloth for the damp and dry cleaning of surfaces, comprising a textile base layer, said base layer having a cleaning side;

a plurality of filament loops obtained by needle tufting of the textile base layer, said plurality of filament loops projecting away from the base layer on the cleaning side, said filament loops being grouped in a plurality of equidirectionally aligned filament-bearing islands that are evenly spaced from one another;

the filaments of the islands projecting at a height of 0.5 mm to 5 mm out of the base layer of the cloth;

said islands each being between 4 mm and 50 mm in length, and having a width of between 2 mm and 10 mm; the islands further being arranged along the cleaning surface of the base layer in a staggered formation with respect to their length, so that an island begins on either side of each end of an island; and the islands being spaced from one another by loop-free, relatively depressed lines extending over the entire extent of the cleaning cloth, the width of these lines between two adjacent long sides of the islands being one to two times the width of the islands, wherein the spacing between adjacent islands is reduced by about ½ to ¼ in regions where adjacent ends of the island approach one another.

2. The cleaning cloth according to claim 1, wherein the textile base layer comprises cellulose and the islands which have the loops consist of synthetic filaments.

3. The cleaning cloth according to claim 2, wherein the islands which have the loops consist of polyester.

4. The cleaning cloth according to claim 1, wherein the cleaning cloth is a non-woven, needle-tufted fiber textile.

5. The cleaning cloth according to claim 2, wherein the cleaning cloth is a non-woven, needle-tufted fiber textile.

6. The cleaning cloth according to claims 1, wherein the islands are colored differently as compared with the regions which lie between them.

7. The cleaning cloth according to claim 1, wherein the filaments have a thicknesses of 1 to 100 dtex.

8. The cleaning cloth according to claim 2, wherein the filaments have a thicknesses of 1 to 100 dtex.

9. The cleaning cloth according to claim 1, having a surface basis weight of 50 to 500 g/m$^2$.

10. The cleaning cloth according to claim 7, having a surface basis weight of 50 to 500 g/m$^2$.

11. A reusable cleaning cloth for cleaning a surface, comprising:

a base layer made of textile;

a plurality of filament loops projecting out of the base layer, said filament loops being grouped in a plurality of evenly spaced apart, oval-shaped islands each having a major axis and a minor axis where the islands reach a maximum and minimum extent respectively, wherein the filaments of the islands project a height of 0.5 mm to 5 mm out of the base layer;

the length of the major axis of the islands is between 4 mm and 50 mm, and the length of the minor axis of the islands is between 2 mm and 10 mm; and the islands being arranged so that corresponding points of the islands lie along a hexagonal array, wherein the distance between adjacent islands whose minor axes are co-linear as measured along a line containing these minor axes is a value d that is between one and two times the length of the minor axis of an island, and the minimum distance between adjacent islands is between one quarter and one half d.

12. The cleaning cloth according to claim 11, wherein the textile base layer comprises cellulose and the islands which have the loops consist of synthetic filaments.

13. The cleaning cloth according to claim 12, wherein the islands which have the loops consist of polyester.

14. The cleaning cloth according to claim 11, wherein the cleaning cloth is a non-woven, needle-tufted fiber textile.

15. The cleaning cloth according to claim 11, wherein the islands are colored differently as compared with the regions which lie between them.

16. The cleaning cloth according to claim 11, wherein the filaments have a thicknesses of 1 to 100 dtex.

17. The cleaning cloth according to claim 11, having a surface weight of 50 to 500 g/m$^2$.

* * * * *